United States Patent [19]

Newberry

[11] Patent Number: 4,837,560

[45] Date of Patent: Jun. 6, 1989

[54] SMOKE ALARM CONTROLLED UNLOCKING APPARATUS FOR WINDOW BARS

[76] Inventor: Chenia L. Newberry, 428 E. 211 St., Carson, Calif. 90745

[21] Appl. No.: 121,788

[22] Filed: Nov. 16, 1987

[51] Int. Cl.[4] ..... G08B 17/12

[52] U.S. Cl. ..... 340/578; 307/66; 340/584; 340/628; 361/170

[58] Field of Search ..... 340/578, 693, 628, 584, 340/577; 49/31, 56, 141; 292/92; 307/23, 64, 66; 361/170

[56] References Cited

U.S. PATENT DOCUMENTS

| | | | |
|---|---|---|---|
| 4,539,555 | 9/1985 | Tefka | 49/31 X |
| 4,540,208 | 9/1985 | Logan, Jr. et al. | 292/92 X |
| 4,671,362 | 6/1987 | Odashima | 340/578 X |
| 4,685,316 | 8/1987 | Hicks et al. | 49/56 X |
| 4,689,610 | 8/1987 | Dietrich | 340/515 |
| 4,706,760 | 11/1987 | Arai et al. | 340/578 X |

*Primary Examiner*—Glen R. Swann, III
*Assistant Examiner*—Thomas J. Mullen, Jr.
*Attorney, Agent, or Firm*—Henry M. Bissell

[57] ABSTRACT

An apparatus is provided for automatically unlocking the guard bars on a window in response to the output signal of a fire detection device. In a preferred embodiment a smoke alarm having a pair of relay-controlled contacts is used in conjunction with a solenoid arrangement to unlock the window bars. Power to the smoke detector and the solenoid circuit is supplied by a rechargeable battery, so that in the event of power failure the automatic window bar unlocking apparatus continues to operate.

9 Claims, 3 Drawing Sheets

SMOKE ALARM CONTROLLED UNLOCKING APPARATUS FOR WINDOW BARS

BACKGROUND OF THE INVENTION

1. Field of the Invention

This invention relates to controlled lock apparatus for barred windows and, in particular, to such apparatus for automatically unlocking window bars in response to a smoke detector.

2. Description of the Related Art

The increasing prevalence of crimes against property has led to the widespread use of window bars on dwellings and other buildings to prevent unauthorized entry through the windows. When bars are permanently mounted on a window without provision for their quick removal or release from the inside, they prevent emergency egress through the window in case of fire in the interior of the building. They also keep firemen and others from effecting the rescue of persons trapped within. Because of many tragic deaths resulting from people being trapped inside buildings with bars on the outside of the windows, various laws and building regulations have been passed in many jurisdictions which require that exterior window bars be unlockable from the interior of the building to which they are attached.

Unlockable window bar arrangements at present still take time to operate so that an occupant of the building can escape through the window in the event of a fire, sometimes requiring that a key be located to unlock the window bars. Since the confusion engendered by smoke and heat associated with a fire can cause even relatively simple tasks to assume the proportions of great difficulty, it would be a great boon to the field of fire safety if there were some means of automatically unlocking window bars in response to a fire in its early stages. An automatic unlocking apparatus for window bars would undoubtedly save many lives that are currently being lost in fires due to panic or clouded judgment under the stressful conditions of a life-threatening emergency.

Smoke alarms are now generally required by law in dwellings. Although some local ordinances require the smoke detectors to be wired to AC line current, a power failure can render them inoperative, and in some cases the power failure is a result of the fire itself. Battery-operated smoke detectors must be periodically checked to insure that the batteries have adequate potential to operate the detector. Neither hard-wired nor battery-operated smoke detectors offer a fail-safe method of warning the occupants of a building in case of fire. It would be an additional great benefit to the field of fire safety if there were available some way of powering smoke detectors that was fail-safe against power failure or battery discharge.

From the above discussion it can be seen that it would be an extremely beneficial advance in the field of fire safety if there were available a window bar locking arrangement which could be automatically unlocked by means of an apparatus which detected a fire in its early stages and at the same time provided a fail-safe power supply for the fire detection device.

SUMMARY OF THE INVENTION

In view of the shortcomings with respect to fire safety of the present state of the art of installing window bars, it is an object of the present invention to provide an apparatus for automatically unlocking window bars by means of a fire detection device.

It is another object of the invention to provide an automatic window bar unlocking apparatus which has a fail-safe source of power for its own operation.

It is yet another object of the invention to provide a system of unlocking window bars quickly and positively in an automatic response to a fire detection device.

Finally it is an object to provide an apparatus for the automatic unlocking of window bars in response to fire which is relatively uncomplicated and inexpensive and requires virtually no maintenance or servicing.

In accordance with these and other objects of the invention, an apparatus is provided which automatically unlocks window bars electromechanically when a fire detection device is activated. A set of protective window bars is hinged on one side and has two locking fixtures attached at its opposite side. The locking fixtures extend through the exterior wall framing the window into the interior. An interior part of each locking fixture has a vertical hole into which a locking pin slides against spring loading. The locking pins are attached to horizontal extensions of a vertical rod. A solenoid whose armature is linked to a cam follower arrangement allows the locking pins to be forcibly withdrawn from their locking fixtures when the solenoid is energized.

In a preferred embodiment a smoke detector with two normally open relay contacts effects energization of the solenoid through a switching relay contained in a power and control circuit. A rechargeable battery powers the smoke detector, the switching relay, and the solenoid coil. A single-pole double-throw momentary contact switch permits testing of the overall system by activating the switching relay. Because neither the smoke detector nor the control and power circuit of the invention depends on house current except to keep the rechargeable battery charged, the operation of the automatic smoke alarm controlled unlocking apparatus of the present invention is not defeated by a power failure. Alternative embodiments could employ signals from a variety of different types of fire detection devices to energize the solenoid which unlocks the window bars. Since the unlocking is done quickly and automatically at the first signs of a fire, any reliance on the possibly impaired motor skills of the building inhabitants due to panic is eliminated. A convenient wall mounting arrangement for the automatic unlocking apparatus is provided.

BRIEF DESCRIPTION OF THE DRAWING

A better understanding of the present invention may be realized from a consideration of the following detailed description, taken in conjunction with the accompanying drawings in which.

DETAILED DESCRIPTION OF THE PREFERRED EMBODIMENT

Figure 1:
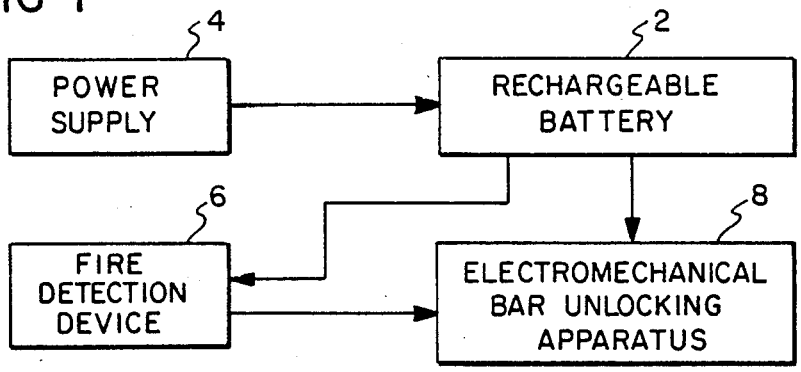
FIG. 1 is a block diagram of one particular arrangement according to the invention.

FIG. 1 is a block diagram of one particular arrangement according to the invention which comprises a rechargeable battery 2, a power supply 4 for charging the rechargeable battery 2, a fire detection device 6, and an electromechanical unlocking apparatus 8. Both the fire detection device 6 and the electromechanical unlocking apparatus 8 are powered by rechargeable battery 2. In a preferred embodiment, the fire detection device 6 is a smoke detector equipped with a pair of relay-controlled contacts which close when smoke is detected. Alternatively the smoke detector would provide an output signal to which electromechanical unlocking apparatus 8 would respond in the event that smoke is detected. Any type of fire detection device 6 which provides an output signal or a pair of relay-controlled contacts can be used instead of a smoke detector. Other types of fire detection devices might include devices which detect the heat or the infrared radiation from a fire or the flame associated with the fire.

Figure 1A:
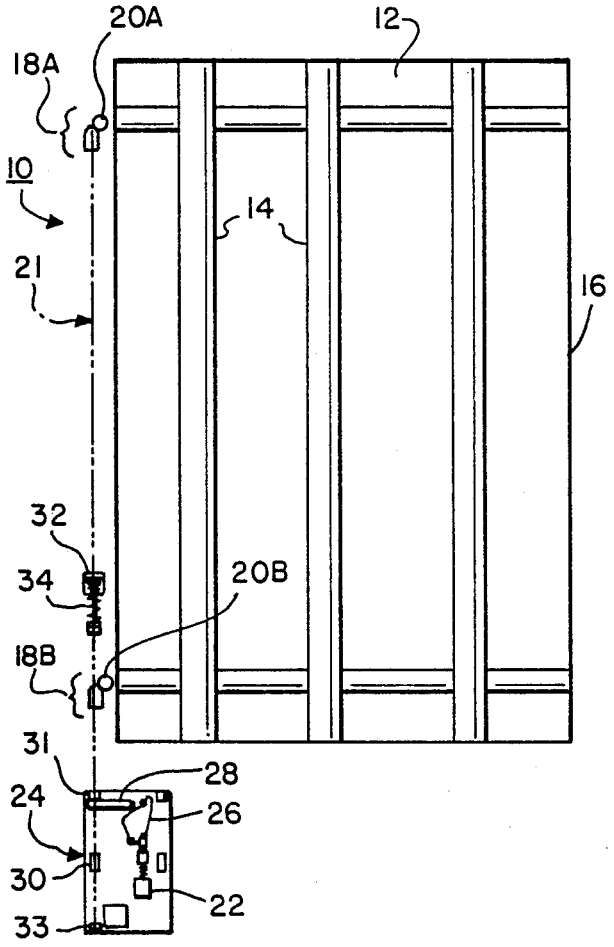
FIG. 1A is a front elevational view of the embodiment of FIG. 1 shown mounted on an interior wall adjacent one side of a window provided with bars on the outside.

Referring to FIG. 1A, a front elevational view is shown of the automatic unlocking apparatus 10 of the present invention mounted on the wall to one side of a window 12 with external protective bars 14 mounted on it. At the right side 16 of the window on the outside a hinging arrangement (not shown) allows the set of protective bars 14 to swing outward about a rotational axis at the right side 16 of the window 14. At the left side of the window 14 in FIG. 1A, locking fixtures **18*a* and 18*b* are mounted in the wall and permanently attached (as by welding) to the set of external bars 14. Locking pins 20*a* and 20*b* attached to an unlocking rod 21 are slidably engaged in vertical holes in locking fixtures 18*a* and 18*b* to secure the set of bars 14** in a closed position.

A solenoid 22 mounted on mounting chassis 24 is linked to a cam 26, a surface of which contacts a cam follower member 28 attached to unlocking rod 21. Mounting chassis 24 is attached to the wall below the side of the window where locking fixtures **18*a* and 18*b* are mounted. Unlocking rod 21 passes through guiding sleeves 30 and 31 and guide bracket 32; it is constrained to move along the direction defined by the mounting of those components. The motion of unlocking rod 21 to the locked position is directed by a manual push member 33 at its lower end. A helical compression spring 34 coaxial with unlocking rod 21 provides a force loading on rod 21** in the same direction as gravity.

Figure 2B:
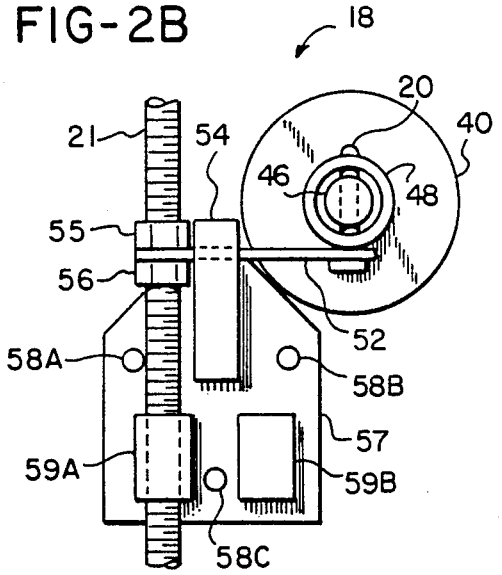
FIG. 2B is a front elevational view of the unlocking apparatus of FIG. 2A viewed from the inside.
Figure 2C:
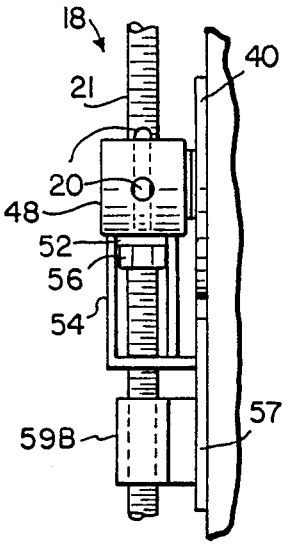
FIG. 2C is a side elevational view of the unlocking apparatus of FIGS. 2A and 2B.
Figure 2A:
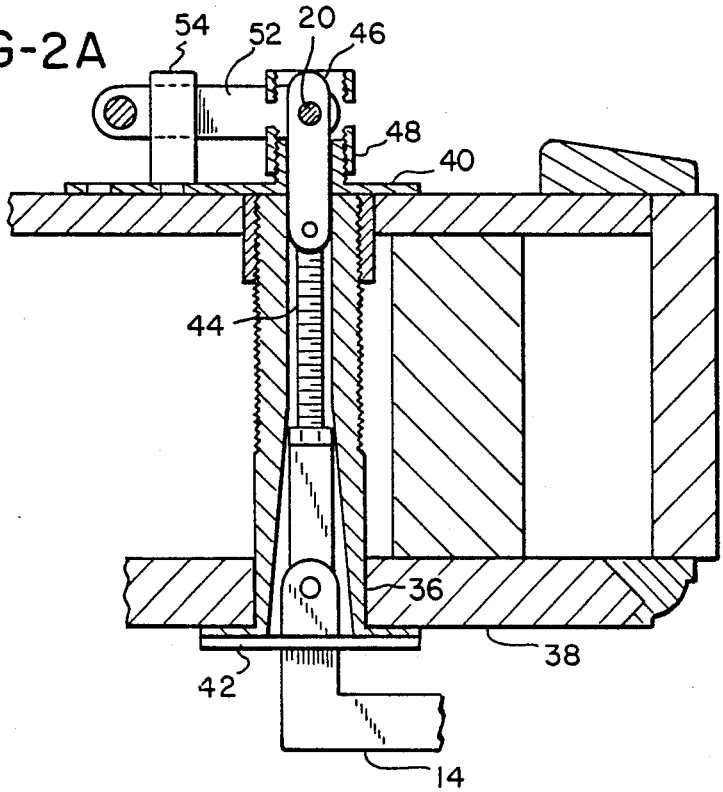
FIG. 2A is a sectional plan view of the unlocking apparatus of the embodiment of FIG. 1 mounted in the wall adjacent a window and attached to an exterior set of bars.

Referring now to FIGS. 2A, 2B, and 2C, details of one of the locking fixtures 18 can be seen. A cylindrical insert 36 is mounted in a hole in wall 38 and held there by cylindrical retaining collar 40 which screws onto a threaded portion of insert 36. Outer flanged member 42 is welded to a horizontal portion of the set of external bars 14. Threaded linking rod 44 is pivotally attached at one end to outer flanged member 42 and pivotally attached at the other end to pivoted linking member 46. Linking rod 44 and linking member 46 pass through the tapered hollow interior of cylindrical insert 36, which has a wider diameter at its outer end. The flanged outer end of cylindrical insert 36 matingly abuts a flanged portion of outer flanged member 42.

A cylindrical bushing 48 screws onto a threaded portion of a retaining collar 40. Four holes spaced 90° apart in the cylindrical wall of bushing 48 allow locking pin 20 to pass through a hole in pivoted locking member 46 to lock the set of exterior bars 14 in a closed position. Linking member 52, from one of end of which locking pin 20 vertically projects, is rigidly attached at its other end to unlocking rod 21. The vertical motion of linking member 52 as locking pin 20 is being withdrawn or inserted into engagement with pivoted linking member 46 is guided and constrained by slotted bracket 54. The position of linking member 52 on unlocking rod 21 is set by adjustment of lock nuts 55 and 56 on the threaded portion of unlocking rod 21.

Referring to FIGS. 2B and 2C, details of one of the mounting brackets 57 can be seen. The two mounting brackets **57*a* and 57*b* are fastened to the wall on a line parallel to the side of the window. This can be accomplished with screws through holes 58*a*, 58*b*, and 58*c*. Depending on which side of the window the apparatus is mounted on, either guiding sleeve 59*a* or guiding sleeve 59*b* on mounting bracket 57 is chosen for use. FIG. 2C illustrates clearly the shape of slotted bracket 54 in which linking member 52 moves as the window bars are locked or unlocked by insertion or withdrawal of the pins 20*a* and 20*b* into or from the cylindrical bushings 48*a* and 48*b*, respectively. The four holes in the cylindrical bushing 48** allow one quarter-revolution of fine adjustment in the position of the bushing as the minimum amount possible.

Figure 3:
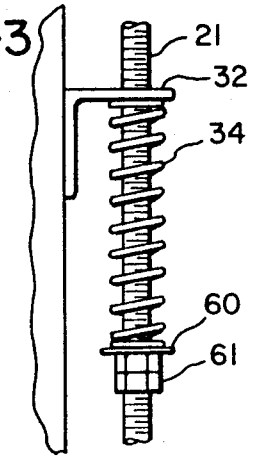
FIG. 3 is a side elevational view of a spring loading portion of FIG. 1A.

FIG. 3 shows the spring loading mechanism for unlocking rod 21. Guide bracket 32, which is attached to the wall adjacent the barred window, has a hole in a horizontal portion through which unlocking rod 21 extends. Spring retaining collar 60 fixed in place by locknut 61 keeps spring 26 in a state of compression which is adjustable by moving collar 60 and locknut 61 up or down on the threaded portion of unlocking rod 21.

Figure 4:
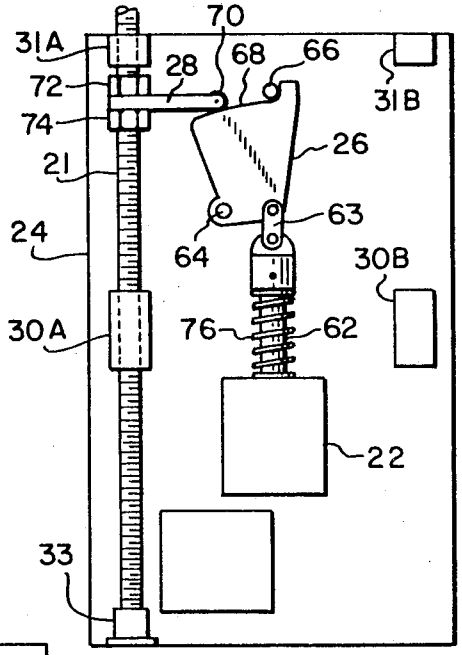
FIG. 4 is a front elevational view of the mounting chassis with the solenoid and unlocking cam portion of FIG. 1A.

Referring now to FIG. 4, which is a front elevational view of the mounting chassis 24, the operation of the unlocking mechanism of the present invention can be understood. A solenoid 22 is mounted on chassis 24 so that its spring loaded armature 62 controls the rotational motion of cam 26 to which it is pivotally connected by pivoted linking member 63. Cam 26 rotates about pivot pin 64 which is attached to chassis 24. The counterclockwise limit of rotation of cam 26 is limited by cam retaining pin 66 mounted on chassis 24. When in its extreme counterclockwise position, cam 26 bears against a roller 70 which is part of cam follower member 28. The position of cam follower member 28 is established by adjustment of lock nuts 72 and 74 on the threaded portion of unlocking rod 21. When solenoid 22 is energized by the passage of current through its coil, armature 62 is pulled downward against the force of spring 76. Cam 26 is thereby rotated in a counterclockwise direction and cam follower member 28 disengages from cam surface 68 to allow locking pins **50*a* and 50*b* to be withdrawn from locking fixtures 18*a* and 18*b* by the downward spring loading force of spring 34 as well as by the force of gravity. The window bars 14 can be relocked by manually pulling unlocking rod 21 upward and resetting the position of cam 26 in its extreme counterclockwise position after solenoid 22** has been deenergized.

Figure 5:
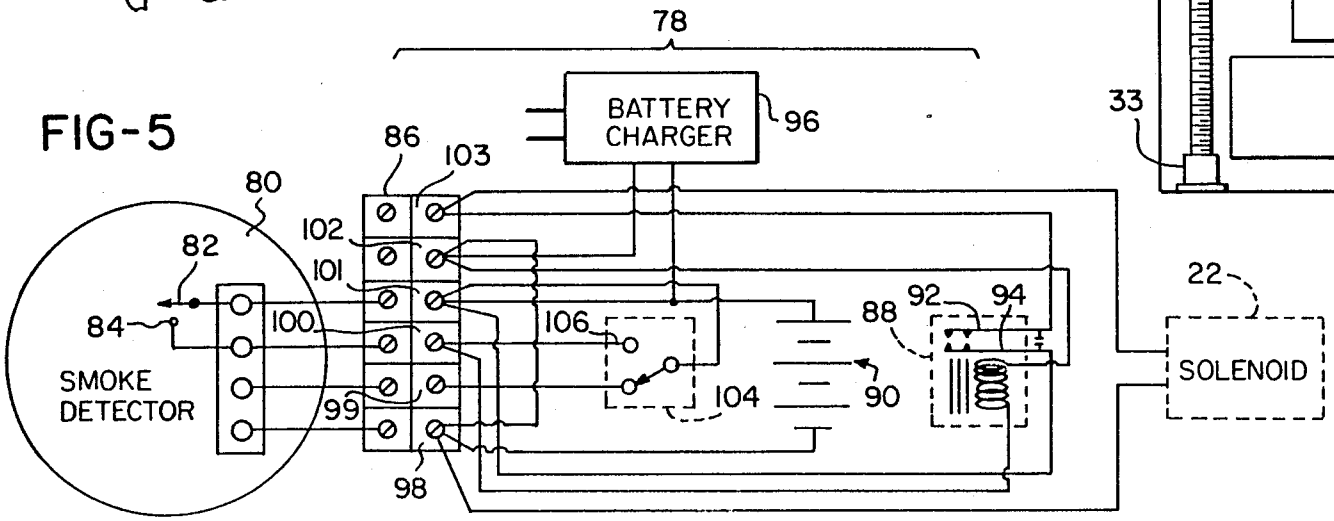
FIG. 5 is a schematic wiring diagram of the smoke detector and the power and control circuit of the inventive embodiment.

FIG. 5 is a schematic wiring diagram of a control and power circuit 78 used to implement the operation of the automatic window bar unlocking apparatus of the present invention. In a preferred embodiment, a smoke detector 80 which has relay-controlled contacts 82 and 84 is connected to circuit 78 through interface terminal strip 86. Smoke detector contacts 82 and 84 are normally open in the absence of any detected smoke. When smoke is detected by smoke detector 80, contacts 82 and 84 become closed, thereby allowing a switching relay 88 to become energized by a rechargeable 12-volt battery 90. Contacts 92 and 94 of switching relay 88 become closed when relay 88 is energized, permitting current from rechargeable battery 90 to flow through the coil of solenoid 22, which effects the withdrawal of locking pins 20*a* and 20*b* from locking fixtures 18*a* and 18*b* as described above.

Battery charger 96, which is powered by AC line current, ensures that rechargeable battery 90 is kept in a fully charged condition. Smoke detector 80 receives its power through contacts 98 and 99 of interface terminal strip 86. Contacts 100 and 101 of terminal strip 86 are used for connection of circuit 78 to the relay-controlled contacts 82 and 84 of smoke detector 80. Contacts 102 and 103 of terminal strip 86 are used as tie points in the control and power circuit 78. Momentary contact switch 104, which is normally closed to terminal 99, is used to test the operation of the system. When switch 104 is depressed, switching relay 88 is energized through contact 106 of momentary contact switch 104 to activate solenoid 22. In this way the overall operation of the system in unlocking the window bars can be tested.

Beneficially, systems in accordance with the present invention fill a long felt need and provide a way of avoiding the sometimes tragic consequences of fire in an inhabited dwelling or other building equipped with window bars, even those which have releasable locking mechanisms. The locking/unlocking mechanisms for such configurations which are provided in accordance with the present invention are automatically unlocked in response to the activation of a fire or smoke detecting device. Thus, persons caught in a building equipped with systems in accordance with the present invention, under fire conditions, are enabled to escape through normally barred and locked windows without the need for having to hunt for a possibly unavailable key or to fumble with manual locking mechanisms which may be out of reach of children or otherwise inoperable by others within the building under the stress of panic or for whatever reason.

There is an additional benefit provided by the present invention: the systems thereof provide increased reliability for the electrical system powering a smoke alarm. At the present time, in certain jurisdictions, smoke alarms powered by AC power mains are mandated by law in place of battery powered units because it has been found that the batteries are often not replaced when they become discharged. However, with the mandated units, it is always possible that a fire may cause an interruption of power which renders such units inoperable. In systems of the present invention, however, an interruption of the mains power will not affect the reliability of the smoke alarm system, since the system is powered from the rechargeable battery of a smoke alarm/window bar unlocking system of the invention. The result is improved reliability for the smoke alarm device, in addition to the provision of automatic unlocking of the barred windows controlled by systems in accordance with the invention.

Although there have been described above specific arrangements of apparatus for automatically unlocking the bars on a window in response to fire detection in accordance with the invention for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the annexed claims.

What is claimed is:

1. A fire safety apparatus comprising:

a rechargeable battery;

a power supply for charging said rechargeable battery;

a fire detection device for producing an output control signal in response to the detection of fire; and an electromechanical window bar unlocking mechanism powered by said reachargeable battery, electrically coupled to said fire detection device and responsive to said control signal to activate said mechanism to its unlocked mode, said mechanism having at least one locking fixture which comprises an outer flanged member having a cylindrical flange part welded to said window bars and a pair of retaining brackets perpendicular to said cylindrical part and spaced apart, each having a hole therethrough along a line parallel to the plane of said cylindrical flange part;

a cylindrical insert threaded at one end and having a cylindrical flange at the other end and a coaxial hollow passage therethrough having a first diameter at one end tapering to a larger, second diameter at the other end;

a threaded linking rod pivotally attached at one end between said retaining brackets;

a pivoted locking member pivotally attached to said linking rod at one end and having a hole near another end;

a cylindrical retaining collar threaded at one end and having a flange of larger radius at the other end with a hole therethrough;

a cylindrical bushing having a threaded interior and four holes spaced 90° apart and perpendicular to the cylindrical axis of said bushing, threaded onto said cylindrical retaining collar;

a mounting bracket having a plurality of holes therethrough;

a slotted bracket through which said linking member passes, attached to said mounting bracket; and a guiding sleeve mounted on said mounting bracket through which said unlocking rod passes.

2. The apparatus of claim 1 in which said fire detection device detects the presence of smoke from said fire.

3. The apparatus of claim 1 in which said fire detection device detects the heat from said fire.

4. The apparatus of claim 1 in which said fire detection device detects a flame associated with said fire.

5. The apparatus of claim 1 in which said fire detection device detects infrared radiation associated with said fire.

6. The apparatus of claim 1 wherein the fire detection device is powered by said rechargeable battery.

7. A fire safety apparatus comprising:

a fire detection device providing a pair of relay-controlled contacts; and a window bar unlocking apparatus connected in circuit with said contacts and operable to unlock an associated window bar assembly in response to the closure of said contacts, said window bar unlocking apparatus including locking means having two locking fixtures, each of which comprises:

an outer flanged member having a cylindrical flange part welded to said window bars and a pair of retaining brackets perpendicular to said cylindrical part and spaced apart, each having a hole therethrough along a line parallel to the plane of said cylindrical flange part;

a cylindrical insert threaded at one end and having a cylindrical flange at the other end and a coaxial hollow passage therethrough having a first diameter at one end tapering to a larger, second diameter at the other end;

a threaded linking rod pivotally attached at one end between said retaining brackets;

a pivoted locking member pivotally attached to said linking rod at one end and having a hole near another end;

a cylindrical retaining collar threaded at one end and having a flange of larger radius at the other end with a hole therethrough;

a cylindrical bushing having a threaded interior and four holes spaced 90° apart and perpendicular to the cylindrical axis of said bushing, threaded onto said cylindrical retaining collar;

a mounting bracket having a plurality of holes therethrough;

a slotted bracket through which said linking member passes, attached to said mounting bracket; and a guiding sleeve mounted on said mounting bracket through which said unlocking rod passes.

8. A fire safety apparatus comprising:

a fire detection device providing a pair of relay-controlled contacts;

a window bar unlocking apparatus connected in circuit with said contacts and operable to unlock an associated window bar assembly in response to the closure of said contacts, said window bar unlocking apparatus comprising:

a control and power interface circuit, and an electromechanical unlocking means for unlocking the bars on a window, which means include a solenoid with a spring-loaded armature connected to a mechanical means of unlocking the bars on said window, said mechanical unlocking means comprising:

a mounting chassis;

first and second guiding sleeves on said chassis;

an unlocking rod having a threaded portion and an unthreaded portion, passing through said guiding sleeves;

a first locking pin extending from said unlocking rod;

a second locking pin extending from said unlocking rod;

a cam;

a linking member pivotally attached at one end thereof to an armature of said solenoid and pivotally attached at the other end thereof to said cam;

a helical compression spring coaxial with said unlocking rod for providing a spring loading on said unlocking rod, a guide bracket having a part abutting said spring, said part having a hole therein through which said unlocking rod slides back and forth;

a spring retaining collar on said unlocking rod keeping said spring confined between said guide bracket and said collar;

a cam follower member extending at right angles from said unlocking rod and making contact with a curved surface of said cam;

a cam pivot pin mounted on said chassis through said cam allowing said cam to rotate; and a cam retaining pin mounted on said chassis limiting the rotational motion of said cam.

9. The apparatus of claim 8 in which said control and power interface circuit comprises:

a switching relay;

a rechargeable battery for powering said switching relay, said fire detection device, and said solenoid;

means for charging said rechargeable battery, electrically connected to said battery;

switch means for testing the operation of said fire safety apparatus; and an interface terminal strip to which said fire detection device, said battery charging means, said switch means, said rechargeable battery, and said switching relay are electrically connected to activate said solenoid when said fire detection device relay-controlled contacts are closed or when said switch means is depressed.

* * * * *